US005996550A

United States Patent [19]

Israel et al.

[11] Patent Number: 5,996,550

[45] Date of Patent: Dec. 7, 1999

[54] APPLIED LOST MOTION FOR OPTIMIZATION OF FIXED TIMED ENGINE BRAKE SYSTEM

[75] Inventors: Mark Israel, Amherst, Mass.; Joseph M. Vorih, West Suffield, Conn.

[73] Assignee: Diesel Engine Retarders, Inc., Wilmington, Del.

[21] Appl. No.: 08/892,312

[22] Filed: Jul. 14, 1997

[51] Int. Cl.[6] ..... F02D 13/04

[52] U.S. Cl. ..... 123/322

[58] Field of Search ..... 123/90.12, 90.16, 123/90.46, 90.55, 90.57, 321

[56] References Cited

U.S. PATENT DOCUMENTS

| | | | |
|---|---|---|---|
| 4,164,917 | 8/1979 | Glasson | 123/90.16 |
| 4,223,648 | 9/1980 | Pozniak et al. . | |
| 4,258,671 | 3/1981 | Takizawa et al. . | |
| 4,278,233 | 7/1981 | Zurner et al. . | |
| 4,399,787 | 8/1983 | Cavanagh . | |
| 4,408,580 | 10/1983 | Kosuda et al. . | |
| 4,452,187 | 6/1984 | Kosuda et al. . | |
| 4,466,390 | 8/1984 | Babitzka et al. . | |
| 4,502,425 | 3/1985 | Wride . | |
| 4,615,306 | 10/1986 | Wakeman . | |
| 4,671,221 | 6/1987 | Geringer et al. . | |
| 4,674,451 | 6/1987 | Rembold et al. . | |
| 4,696,265 | 9/1987 | Nohira . | |
| 4,716,863 | 1/1988 | Pruzan . | |
| 4,796,573 | 1/1989 | Wakeman et al. . | |
| 4,887,562 | 12/1989 | Wakeman . | |
| 4,889,084 | 12/1989 | Rembold . | |
| 4,889,085 | 12/1989 | Yagi et al. . | |
| 4,892,067 | 1/1990 | Paul et al. . | |
| 4,919,089 | 4/1990 | Fujiyoshi et al. . | |
| 4,930,465 | 6/1990 | Wakeman et al. . | |
| 4,977,867 | 12/1990 | Rhoads . | |
| 4,982,706 | 1/1991 | Rembold . | |
| 5,005,540 | 4/1991 | Watanabe . | |
| 5,088,458 | 2/1992 | Wakeman et al. . | |
| 5,103,779 | 4/1992 | Hare . | |
| 5,113,811 | 5/1992 | Rembold et al. . | |
| 5,119,774 | 6/1992 | Krieg et al. . | |
| 5,146,890 | 9/1992 | Gobert et al. . | |
| 5,158,048 | 10/1992 | Robnett et al. . | |
| 5,201,290 | 4/1993 | Hu . | |
| 5,216,988 | 6/1993 | Taxon . | |
| 5,451,029 | 9/1995 | Kruger . | |
| 5,485,813 | 1/1996 | Molitor et al. . | |
| 5,488,934 | 2/1996 | Shirai et al. . | |
| 5,499,606 | 3/1996 | Robnett et al. . | |
| 5,503,120 | 4/1996 | Shirey et al. . | |
| 5,680,841 | 10/1997 | Hu | 123/321 |

FOREIGN PATENT DOCUMENTS

| | | |
|---|---|---|
| 3815688 A1 | 11/1989 | Germany . |

*Primary Examiner*—Erick R. Solis
*Attorney, Agent, or Firm*—Collier, Shannon, Rill & Scott, PLLC; David R. Yohannan

[57] ABSTRACT

An internal combustion engine may include a hydraulic linkage used to transfer motion from a valve train element, such as a cam, to an engine valve. Method and apparatus for selectively limiting the motion transferred by the hydraulic linkage from the valve train element to the engine valve are disclosed. The hydraulic linkage may comprise means for resetting or clipping the displacement of the engine valves into the engine cylinder following a compression release event. The hydraulic linkage may also limit the displacement of the engine valves into the engine cylinder for main exhaust and/or other valve events, as well as limit the overlap between a main exhaust valve event and an intake valve event.

26 Claims, 9 Drawing Sheets

APPLIED LOST MOTION FOR OPTIMIZATION OF FIXED TIMED ENGINE BRAKE SYSTEM

FIELD OF THE INVENTION

The present invention relates generally to valve actuation in internal combustion engines that include compression release-type engine retarders. In particular, it relates to methods and apparatus for controlling valve lift and duration for compression release valve events and main exhaust valve events.

BACKGROUND OF THE INVENTION

Engine retarders of the compression release-type are well-known in the art. Engine retarders are designed to convert, at least temporarily, an internal combustion engine of compression-ignition type into an air compressor. In doing so, the engine develops retarding horsepower to help slow the vehicle down. This can provide the operator increased control over the vehicle and substantially reduce wear on the service brakes of the vehicle. A properly designed and adjusted compression release-type engine retarder can develop retarding horsepower that is a substantial portion of the operating horsepower developed by the engine in positive power.

Safety, reliability and environmental demands have pushed the technology of compression release engine retarding significantly over the past 30 years. Compression release retarding systems are typically adapted to a particular engine in order to maximize the retarding horsepower that could be developed, consistent with the mechanical limitations of the engine system. In addition, over the decades during which these improvements were made, compression release-type engine retarders garnered substantial commercial success. Engine manufacturers have become more willing to embrace compression release retarding technology. Compression release-type retarders have continued to enjoy substantial and continuing commercial success in the marketplace. Accordingly, engine manufacturers have been more willing to make engine design modifications, in order to accommodate the compression release-type engine retarder, as well as to improve its performance and efficiency.

In addition to these pressures, environmental restrictions have forced engine manufacturers to explore a variety of new ways to improve the efficiency of their engines. These changes have forced a number of engine modifications. Engines have become smaller and more fuel efficient. Yet, the demands on retarder performance have often increased, requiring the compression release-type engine retarder to generate greater amounts of retarding horsepower under more limiting conditions.

As the market for compression release-type engine retarders has developed and matured, the aforementioned factors have pushed the direction of technological development toward a number of goals: securing higher retarding horsepower from the compression release retarder; working with, in some cases, lower masses of air deliverable to the cylinders through the intake system; and the inter-relation of various collateral or ancillary equipment, such as: silencers; turbochargers; and exhaust brakes. In addition, the market for compression release engine retarders has moved from the after-market, to original equipment manufacturers. Engine manufacturers have shown an increased willingness to make design modifications to their engines that would increase the performance and reliability and broaden the operating parameters of the compression release-type engine retarder.

Functionally, compression release-type retarders supplement the braking capacity of the primary vehicle wheel braking system. In so doing, it extends substantially the life of the primary (or wheel) braking system of the vehicle. The basic design for a compression release engine retarding system of the type involved with this invention is disclosed in Cummins, U.S. Pat. No. 3,220,392, issued November 1965.

The compression release-type engine retarder disclosed in the Cummins '392 patent employs a hydraulic system or linkage. The hydraulic linkage of a typical compression release-type engine retarder may be linked to the valve train of the engine. When the engine is under positive power, the hydraulic linkage may be disabled from providing valve actuation. When compression release-type retarding is desired, the hydraulic linkage is enabled such that valve actuation is provided by the hydraulic linkage responsive to an input from the valve train.

Among the hydraulic linkages that have been employed to control valve actuation (both in braking and positive power), are so-called "lost-motion" systems. Lost-motion, per se, is not new. It has been known that lost-motion systems are useful for variable valve control for internal combustion engines for decades. In general, lost-motion systems work by modifying the hydraulic or mechanical circuit connecting the actuator (typically the cam shaft) and the valve stem to change the length of that circuit and lose a portion or all of the cam actuated motion that would otherwise be delivered to the valve stem to actuate a valve opening event. In this way lost-motion systems may be used to vary valve event timing, duration, and the valve lift.

Compression release-type engine retarders may employ a lost motion system in which a master piston engages the valve train (e.g. a push tube, cam, or rocker arm) of the engine. When the retarder is engaged, the valve train actuates the master piston, which is hydraulically connected to a slave piston. The motion of the master piston controls the motion of the slave piston, which in turn may open the exhaust valve of the internal combustion engine at a point near the end of a piston's compression stroke. In doing so, the work that is done in compressing the intake air cannot be recovered during the subsequent expansion (or power) stroke of the engine. Instead, it is dissipated through the exhaust and radiator systems of the engine. By dissipating energy developed from the work done in compressing the cylinder gases, the compression release-type retarder dissipates the kinetic energy of the vehicle, which may be used to slow the vehicle down.

Regardless of the specific actuation means chosen, inherent limits were imposed on operation of the compression release-type retarder based on engine parameters. One such engine parameter is the physical relationship of an engine cylinder valve used for compression release braking and the piston in the same cylinder. If the extension of the valve into the cylinder was unconstrained during compression release braking, the valve could extend so far down into the cylinder that it impacts with the piston in the cylinder.

There may be a significant risk of valve-to-piston contact when a unitary cam lobe is used to impart the valve motion for both the compression release valve event and the main exhaust valve event. Use of a unitary cam lobe for both events means that the relatively large main exhaust lobe motion will be imparted to the hydraulic linkage, or more particularly to the slave piston. Because there is typically little or no lash between the slave piston and the exhaust valve, input of the main exhaust event motion to the slave piston may produce a greater than desired main exhaust event.

Accordingly, there is a need for a system and method for avoiding the occurrence of valve-to-piston contact when a unitary cam lobe is used to impart the valve motion for both a compression release event and a main exhaust valve event. More particularly, there is a need for a system and method of limiting the stroke or displacement of a slave piston when a lost motion system is imparted with the motion from a main exhaust cam lobe.

One way of avoiding valve-to-piston contact as a result of using a unitary cam lobe for both compression release valve events and main exhaust valve events is to limit the motion of the slave piston which is responsible for pushing the valve into the cylinder during compression release braking. A device that may be used to limit slave piston motion is disclosed in Cavanagh, U.S. Pat. No. 4,399,787 (Aug. 23, 1983) for an Engine Retarder Hydraulic Reset Mechanism, which is incorporated herein by reference. Another device that may be used to limit slave piston motion is disclosed in Hu, U.S. Pat. No. 5,201,290 (Apr. 13, 1993) for a Compression Relief Engine Retarder Clip Valve, which is also incorporated herein by reference. Both of these (reset valves and clip valves) may comprise means for blocking a passage in a slave piston during the downward movement of the slave piston (such as the passage 344 of the slave piston 340 of FIG. 6). After the slave piston reaches a threshold downward displacement, the reset valve or clip valve may unblock the passage through the slave piston and allow the oil displacing the slave piston to drain there through, causing the slave piston to return to its upper position under the influence of a return spring.

A reset valve, such as the one disclosed in Cavanagh, may be provided as part of a lash adjuster or a slave piston. A reset valve may comprise a hydraulically actuated means for unblocking a passage through the slave piston to limit the displacement of the slave piston. In Cavanagh, compression release retarding is carried out by opening one of two valves connected by a crosshead member or bridge. A purpose of the reset valve used in Cavanagh is to reseat the exhaust valve used for the compression release event before a subsequent main exhaust valve event so that the rocker arm will not push down on an unbalanced crosshead during the main exhaust event and transmit a bending force to the crosshead guide pin or to the non-braking valve stem.

A clip valve, such as the one disclosed in Hu, may comprise a mechanically actuated means for unblocking the passage through the slave piston to limit the displacement of the slave piston. A purpose of the Hu clip valve is to enable a sharp hydraulic pulse to be applied to the slave piston to rapidly open an exhaust valve while maintaining an accurate limit on the extension of the slave piston.

FIG. 1 illustrates a system in which a cam section 110 is connected to valves 200 by both a hydraulic linkage 300 and a mechanical linkage 400. With reference to FIG. 1, the actuation provided by the hydraulic linkage 300, which may include a slave piston, during the main exhaust valve event may be further limited by providing the mechanical linkage 400 with a greater actuation ratio than that of the hydraulic linkage. For example, for each unit of linear motion input to the hydraulic and mechanical linkages, the hydraulic linkage may transfer 1.3 units of linear motion to the valve 200 while the mechanical linkage may transfer 1.5 units of linear motion. By differing the actuation ratios of the hydraulic and mechanical linkages, the mechanical linkage 400 may be able to make up the lash distance 410 and thereby dominate the actuation of the valve 200 during the main exhaust portion 114 of the cam lobe.

Use of a unitary cam lobe for both the compression release event and the main exhaust event may also result in excessive overlap between the opening of the exhaust valve for the main exhaust valve event and the opening of the intake valve for the main intake event. With reference to FIG. 3, when the main exhaust event is input to the slave piston, the exhaust valve motion may be represented by curve 520–620 and the overlap of the main exhaust event with the main intake event may be illustrated by the combined shaded areas 650 and 652. The overlap represented by areas 650 and 652 may dramatically reduce brake effectiveness because intake charge (mass) used for the subsequent compression release event may pass right through the cylinder and out the exhaust port.

Accordingly, there is a need for a system and method for limiting and controlling the overlap between the main exhaust event and the main intake event when a unitary cam lobe is used to provide both a compression release event and the main exhaust event.

There also remains a significant need for a system and method for controlling the actuation of the exhaust valve in order to increase the effectiveness of and optimize the compression release retarding event. Further, there remains a significant need for a system that is able to perform that function over a wide range of engine operating parameters and conditions. In particular, there remains a need to "tune" the compression release-type retarder system in order to optimize its performance Whereas, exhaust valve actuation for retarding that can be provided by the existing cam profiles (valve or injector) may not produce this result.

OBJECTS OF THE INVENTION

It is therefore an object of the present invention to provide an actuation means for retarding that optimizes engine retarding performance.

It is another object to provide a system and method of providing compression release and main exhaust valve actuation with a unitary cam lobe.

It is another object of the present invention to provide a system and method for avoiding valve-to-piston contact during a main exhaust valve event.

It is a further object of the present invention to provide a system and method for limiting the stroke of a lost motion system slave piston during a main exhaust event.

It is yet another object of the present invention to provide a system and method for resetting a lost motion system slave piston following a compression release valve event.

It is still another object of the present invention to provide a system and method for clipping the motion of a lost motion system slave piston during a main exhaust valve event.

It is still a further object of the present invention to provide a system and method for ensuring that the motion input from a mechanical linkage to an exhaust valve during a main exhaust event exceeds the motion input from a hydraulic linkage to the exhaust valve.

It is still yet another object of the present invention to provide a system and method for controlling the overlap between a main intake valve event and the main exhaust valve event.

SUMMARY OF THE INVENTION

In response to this challenge, Applicants have developed innovative and reliable systems and apparatus to achieve control of the engine valves in a compression release-type engine retarder using lost-motion. In accordance with the teachings of the present invention, the present invention is an engine braking system, for providing a main exhaust valve event and a compression release valve event in an internal combustion engine, comprising: means for imparting motion to an engine valve; first means for transferring motion from said imparting means to the engine valve; hydraulic means for transferring motion from said imparting means to the engine valve; and means for controlling the amount of motion transferred by said hydraulic means to the engine valve such that the motion transferred by said hydraulic means is less than the motion transferred by said first means during the main exhaust valve event.

An alternate embodiment invention comprises a method of providing a compression release valve event and a main exhaust valve event from a unitary cam lobe and in which said compression release valve event is provided by a hydraulic linkage between said valve and said cam lobe and said main exhaust event is provided by a mechanical linkage between said valve and said cam lobe, and wherein the method of limiting the stroke of the exhaust valve during the main exhaust valve event comprises the step of selectively reducing the hydraulic pressure in the hydraulic linkage at the conclusion of the compression release valve event and prior to the main exhaust valve event.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE PREFERRED EMBODIMENTS

Figure 1:
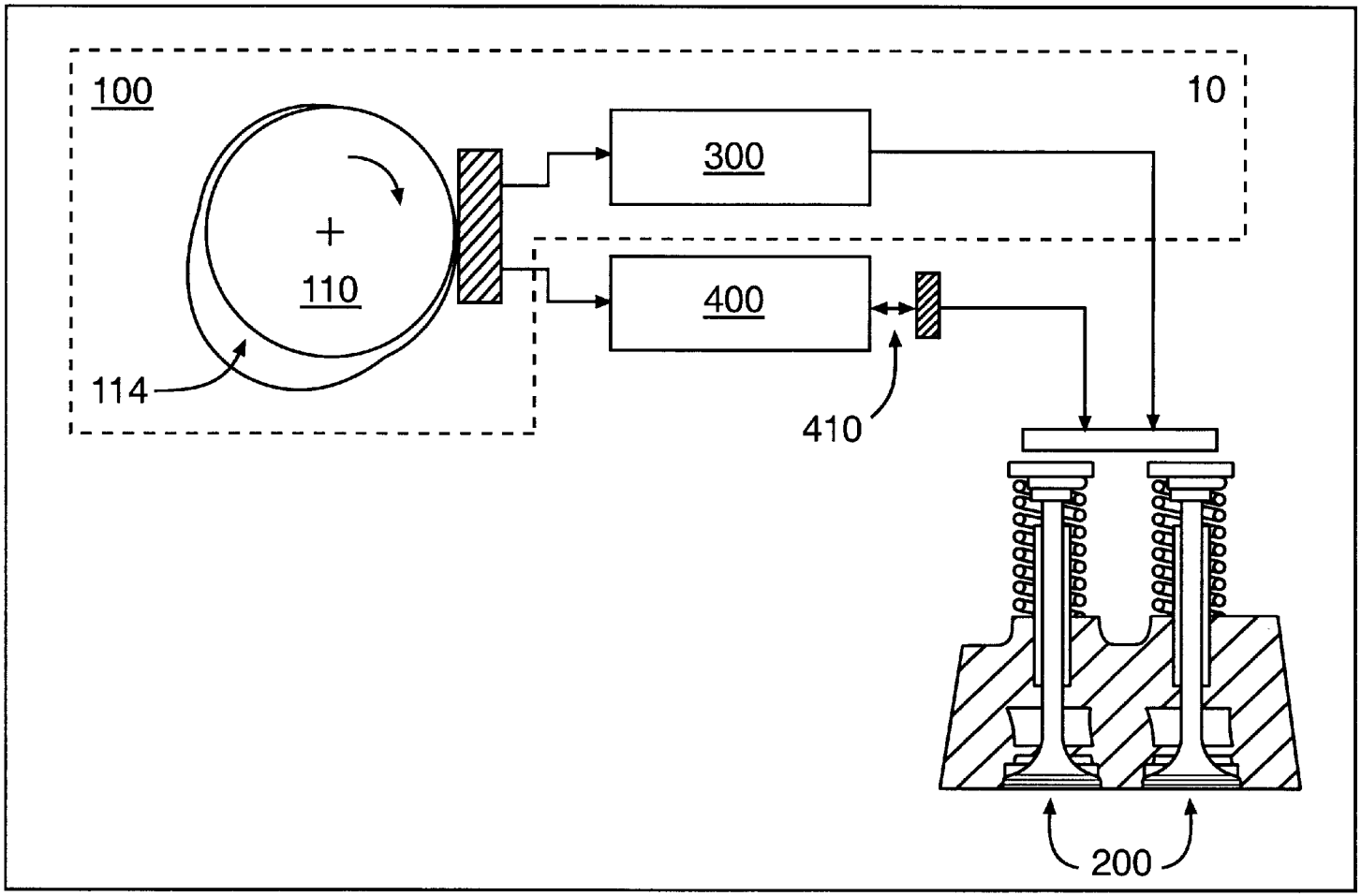
FIG. 1 is a schematic drawing illustrating fundamental elements of the lost motion fixed timed system embodiment of the invention.

Reference will now be made in detail to a preferred embodiment of the present invention, an example of which is illustrated in the accompanying drawings. A preferred embodiment of the present invention is shown in FIG. 1 as engine braking system 10. The engine braking system 10 shown in FIG. 1 may include a means for imparting motion 100 to an engine valve 200, a hydraulic linkage 300, and a mechanical linkage 400 connecting the motion imparting means and the engine valve. The hydraulic linkage 300 and the mechanical linkage 400 may each independently link the motion imparting means 100 to the valve 200 such that linear motion imparted from the motion imparting means 100 to the hydraulic linkage 300 and the mechanical linkage 400 may be transferred by these linkages to the valve 200. In this manner the motion imparting means 100 provides motion to open the valve 200 for various engine valve events, e.g. compression release valve events and main exhaust valve events.

The motion imparting means 100 may be provided by a cam section 110 having fixed compression release, main exhaust, and EGR lobes 114 (or a unitary cam). The lift of the main exhaust portion of the lobe 114 provides a linear input to both the hydraulic linkage 300 and the mechanical linkage 400. By building a lash space 410 into the mechanical linkage, the linear input of the beginning and end of lobe 114 may be absorbed by the mechanical linkage 400 and thereby not transferred by the mechanical linkage to the valve 200.

The hydraulic linkage 300 may be provided as a lost motion system so that the linear input of the lobe 114 may be selectively "lost" or absorbed by the hydraulic linkage 300 and thereby not transferred by the hydraulic linkage to the valve 200. When the engine braking system 10 is turned "off", the hydraulic linkage 300 may lose all, or a predetermined portion, of the linear motion imparted to it by the lobe 114. When the engine braking system 10 is turned "on", the hydraulic linkage 300 may lose only a selective portion, or none, of the linear motion imparted to it by the lobe.

When the hydraulic linkage 300 is turned "on," the hydraulic linkage could completely control the actuation of the valve 200 for the main exhaust, compression release, and EGR portions of the cam 110. Each event (main exhaust, compression release, etc.) may be dictated by a lobe on the unitary cam. If the hydraulic linkage were permitted to impart the full displacement provided by the main exhaust portion of the cam lobe 114 to the valve 200, the valve may be displaced far enough into the engine cylinder at top dead center intake that it impacts with the piston. Therefore, the actuation provided by the hydraulic linkage 300 may be selectively reduced following the compression release and EGR portions of the cam 110, and particularly before the main exhaust portion of the cam lobe.

Figure 4:
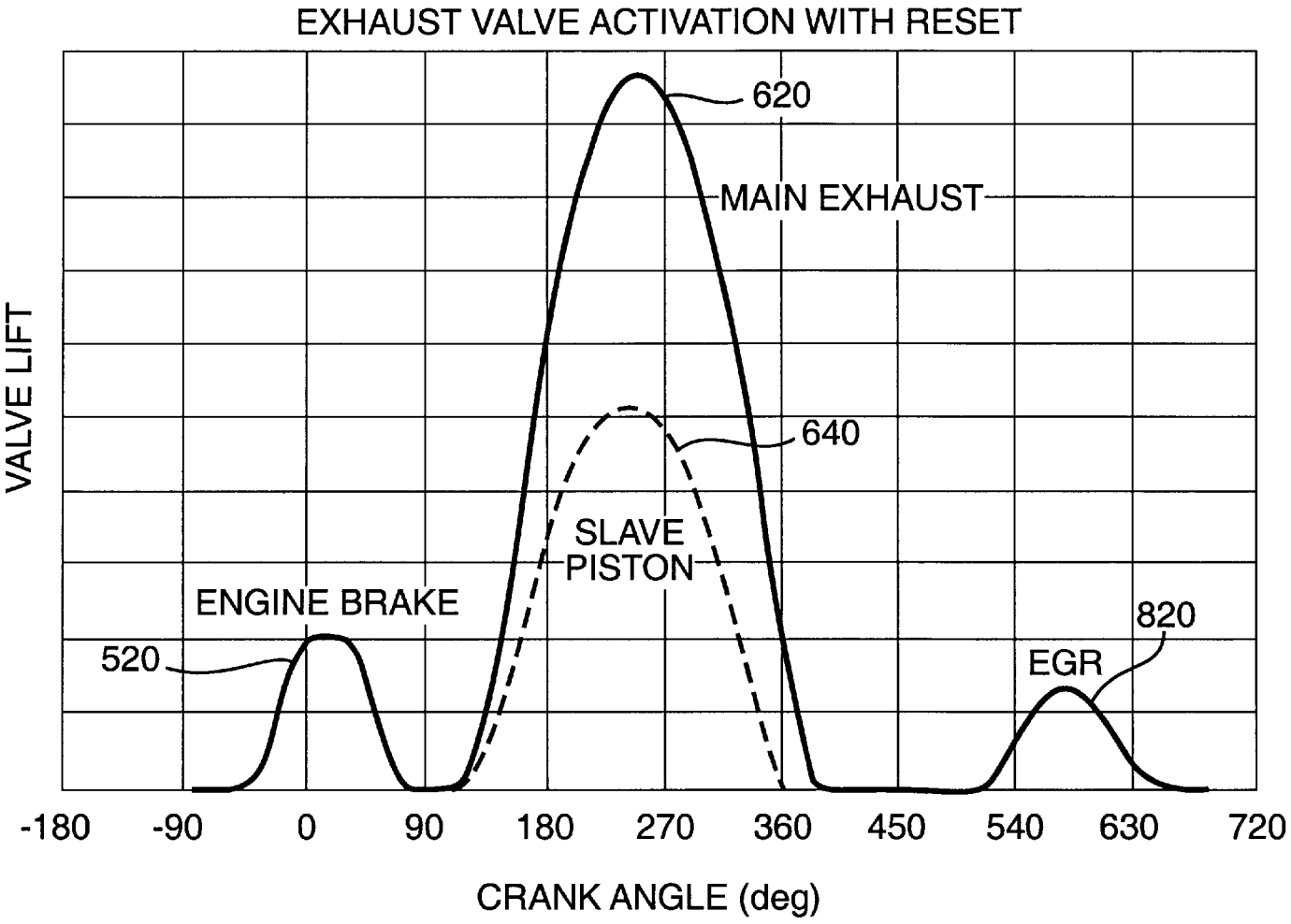
FIG. 4 is a graph of exhaust valve events, including engine braking, main exhaust, and exhaust gas recirculation (EGR) events, using a reset valve.

FIG. 4 illustrates the lift verses crank angle for an exhaust valve employing a reset valve (curve 520–620). The main exhaust event 620 is produced by a mechanical linkage (e.g. a rocker arm), while the engine brake events 520 and 820 are produced by the hydraulic linkage.

Figure 5:
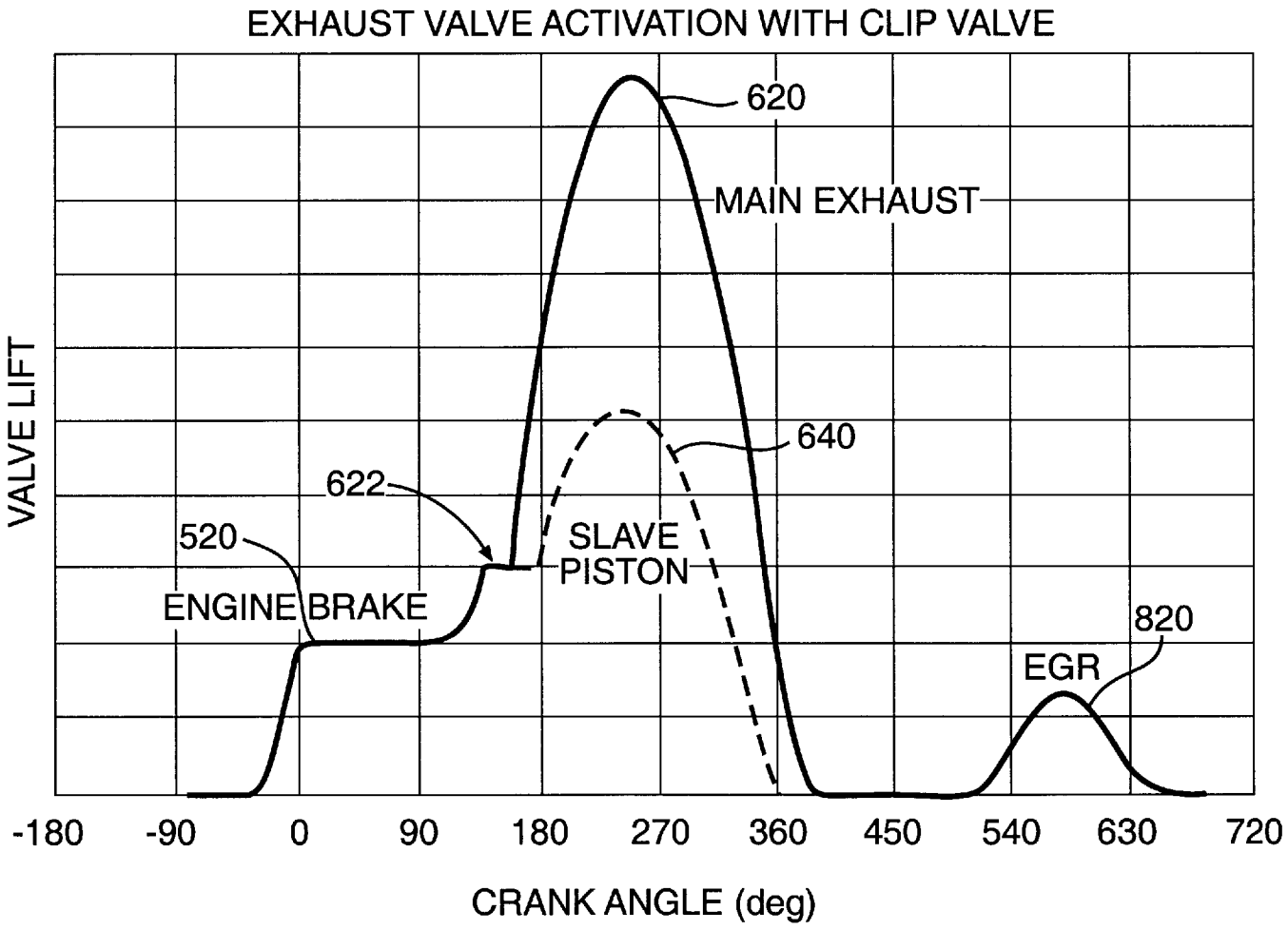
FIG. 5 is a graph of exhaust valve events, including engine braking, main exhaust, and EGR events, using a clip valve.

FIG. 5 illustrates the lift versus crank angle for an exhaust valve employing a clip valve (curve 520–620). Given the same cam lobe input, the valve lift resulting from the combined hydraulic and mechanical linkage (without a clip valve) can exceed the valve lift resulting from the combined linkage (with a clip valve).

With reference to FIG. 4, the compression release valve event the main exhaust valve event, and the EGR event, may be governed by the curves 520, 620 and 820, respectively. As illustrated by the curves, after the compression release event 520 the valve may be reset to base circle; i.e. the hydraulic linkage is reset and the mechanical linkage has no influence yet because of the lash distance. By resetting the hydraulic linkage after the compression release event 520 the main exhaust event is governed solely by the mechanical linkage and therefore the lift corresponding to the main exhaust event during braking 620 is the same lift as for the main exhaust event 630 provided during positive power. The main exhaust event is solely governed by the mechanical linkage because the available lift from the hydraulic linkage, represented by curve 640, is less than the lift provided by mechanical linkage. The lift available from the hydraulic linkage may be less than that of the mechanical linkage because the hydraulic ratio is less than the rocker ration, and because a reset or clip valve may lose a portion of the motion of the hydraulic linkage.

In FIG. 5, in which like numerals refer to like elements of FIG. 4, rather than resetting the hydraulic linkage after the compression release event 520, the hydraulic linkage may be clipped at the beginning 622 of the main exhaust event 620. Because the hydraulic linkage is clipped, the main exhaust event may be solely governed by the actuation of the mechanical linkage.

Figure 2:
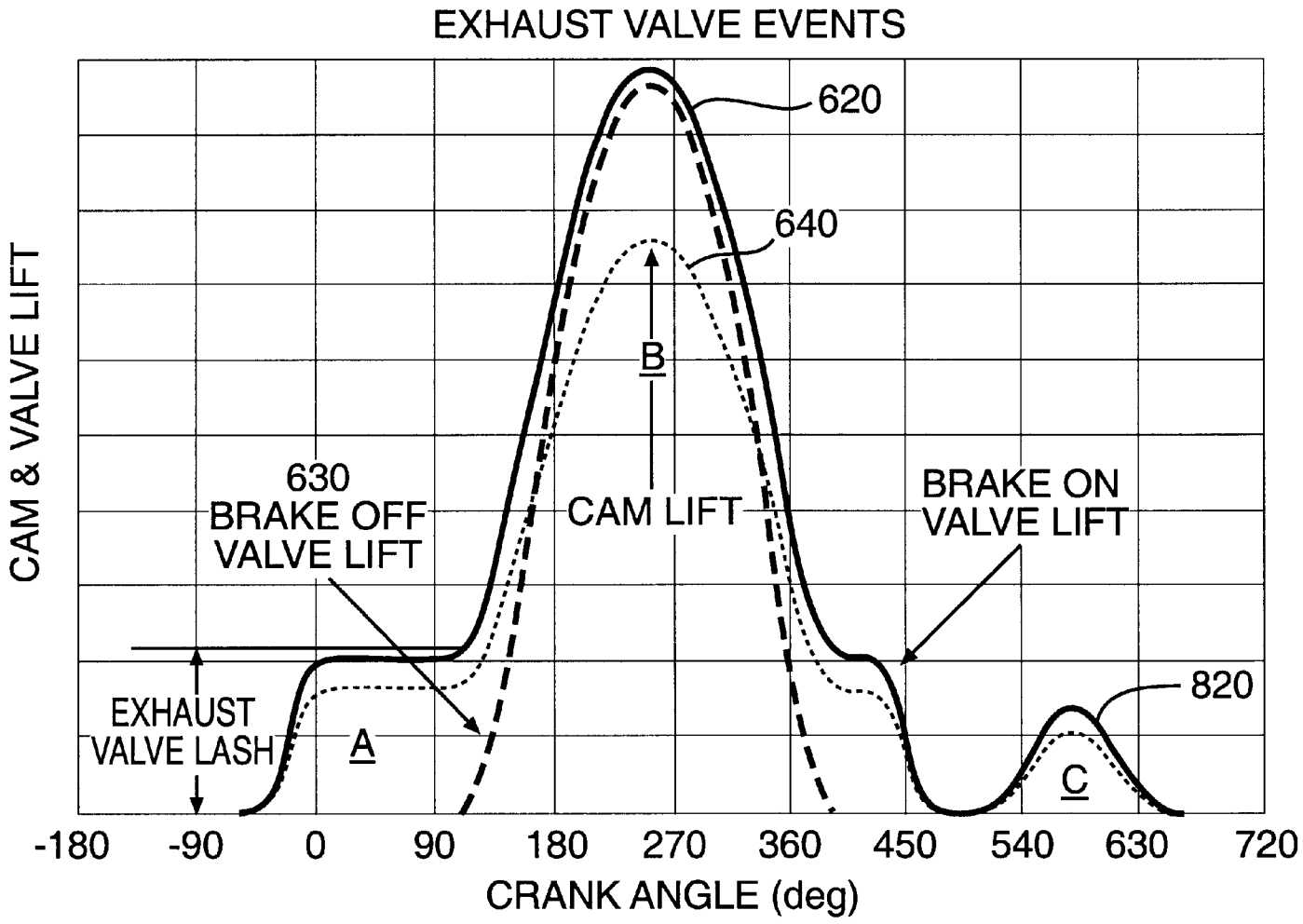
FIG. 2 is a graph of exhaust valve events, including mechanical and hydraulic actuation resulting from the cam profile, which illustrates the functioning of an embodiment of the invention.
Figure 3:
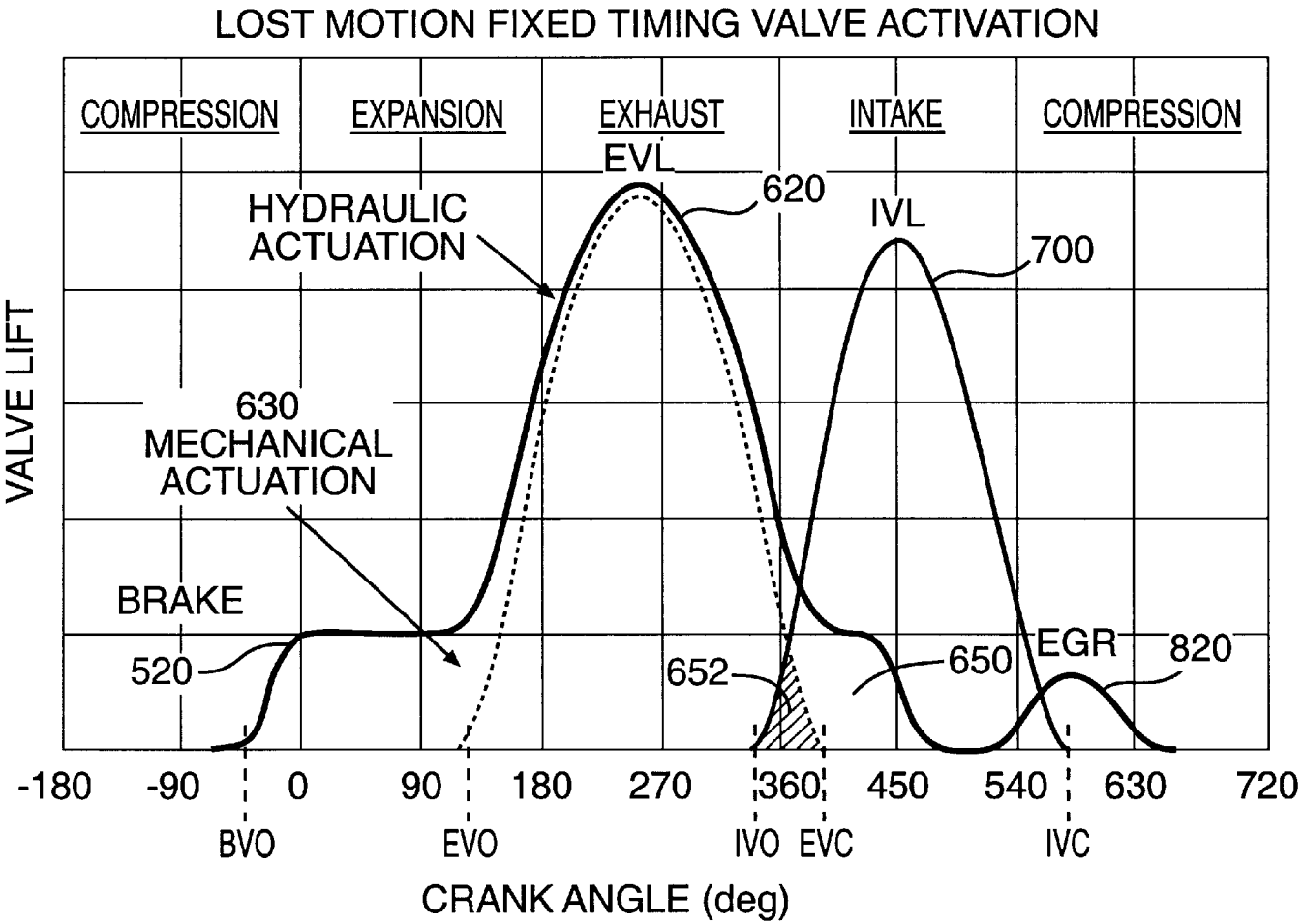
FIG. 3 is a graph of exhaust valve and intake valve events, including mechanical and hydraulic actuation, and which illustrates an embodiment of the invention.

Selective reduction of the actuation provided by the hydraulic linkage is useful in a second context. With reference to FIGS. 2 and 3, in which like reference numerals refer to like elements, the main exhaust valve event 620 would be prolonged during engine braking absent reduction of the hydraulic linkage actuation. The main exhaust valve event provided with reduction of the hydraulic linkage is illustrated by curve 620 in FIGS. 4 and 5. With reference to FIG. 3, the unreduced main exhaust valve event 620 in FIGS. 2 and 3 may produce overlap between the intake valve event 700 and the main exhaust valve event 620, illustrated by the combined light shaded area 650 and dark shaded area 652. The overlap represented by combined areas 650 and 652 may produce excessive exhaust gas recirculation in the gas exchange process occurring near top dead center (360°) of the piston cycle. Excessive overlap may detrimentally affect brake performance because the early intake charge passes out through the open exhaust valve rather than being trapped in the cylinder for use in the subsequent braking event. In contrast, when the main exhaust valve event is provided solely by the mechanical linkage, as illustrated by curve 630, the overlap between the intake valve event and the main exhaust valve event is limited to dark shaded area 652. By reducing the overlap, excessive gas exchange may be avoided.

Figure 6:
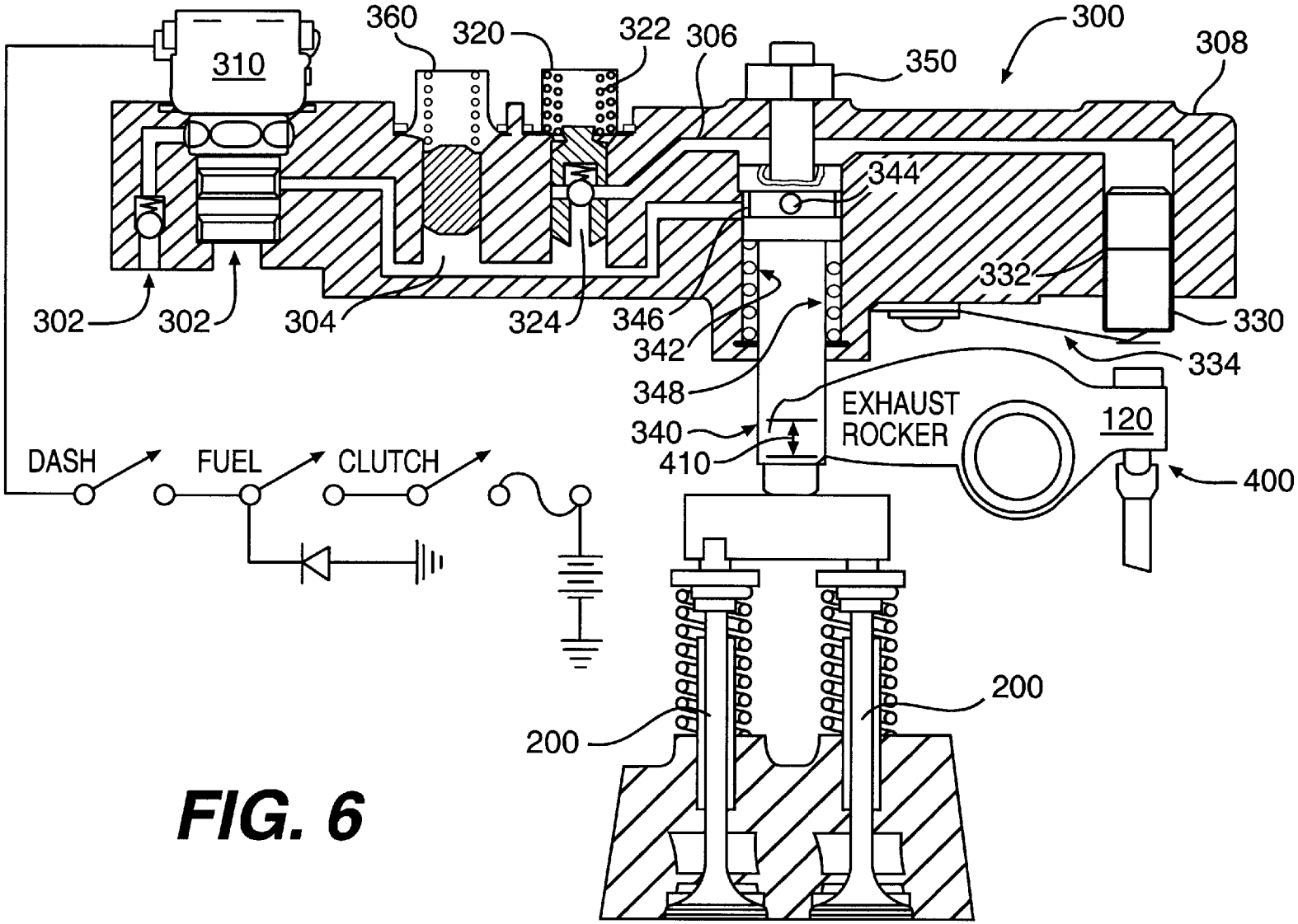
FIG. 6 is a cross-sectional view in elevation of an embodiment of the invention utilizing a reset or clip valve, a master-slave piston circuit, and a low pressure, normally closed, on/off solenoid valve.

A preferred embodiment of the invention is further illustrated with reference to FIG. 6, in which like elements are referred to with like reference numerals. In FIG. 6, the hydraulic linkage 300 may be turned on by applying a voltage to a solenoid valve 310 to open the solenoid valve and permit oil to be provided from a sump (not shown) by a low pressure pump (not shown) through a check valve 302 and through the open solenoid valve 310. The low pressure oil may flow into a passage 304 and push open a control valve 320 against the bias of a control valve return spring 322. After the control valve 320 is opened, the low pressure oil may pass through a check valve 324 in the control valve 320 and into a passage 306 which provides communication between a master piston 330 and a slave piston 340. After the passage 306 is filled with low pressure oil, which cannot escape back past the check valve 324, the system is ready to provide valve actuation via the hydraulically linked master piston 330 and slave piston 340.

The master piston 330 may be slidably retained in a bore 332 by a retaining spring 334. As the master piston 330 is forced upward in the bore 332 by the movement of the valve train element 120, the oil displaced by the master piston 330 may cause the slave piston 340 to be downwardly displaced in its associated bore 342. Downward displacement of the slave piston 340, in turn opens the valves 200.

The downward displacement of the slave piston 340 may be limited by providing a passage 344 in the slave piston connecting the top of the slave piston with an annular groove 346 in the side of the slave piston. The slave piston 340 may be displaced downward to a predetermined extent, at which point communication is established between the high pressure oil passage 306 and the low pressure oil passage 304 via the slave piston passage 344 and the annular groove 346. Communication between the high pressure and low pressure oil passages causes the high pressure passage 306 to drain and the slave piston 340 to be upwardly displaced under the influence of a slave piston return spring 348. Oil which flows to the low pressure passages may be temporarily stored in accumulator 360.

The upper position of the slave piston 340 may be limited by a lash adjuster 350, which provides a mechanical stop against which the slave piston may be biased by the return spring 348. The extension of the lash adjuster into the high pressure passage may be adjusted by screwing the lash adjuster in or out of the hydraulic linkage 300 housing 308.

When no compression release retarding and/or exhaust gas recirculation is desired, the solenoid valve 310 may be closed and the low pressure oil passage 304 may drain through a solenoid exhaust port passage 312 back to the sump. The draining of the low pressure oil from the low pressure passage 304 may cause the control valve 320 to return to a lower position under the influence of the return spring 322. Once the control valve 320 assumes a lower position, the high pressure oil may drain from the passage 306 over the control valve 320, effectively turning off the brake.

As is apparent from the explanation of the hydraulic linkage 300 shown in FIG. 6, limitation of the downward displacement of the slave piston may be fixed by the position of the annular groove 346 on the slave piston and the location of the intersection of the low pressure oil passage 304 and the slave piston bore 342. The limitation of the downward displacement of the slave piston may alternatively be achieved through the use of a reset valve or clip valve 350.

Figure 7:
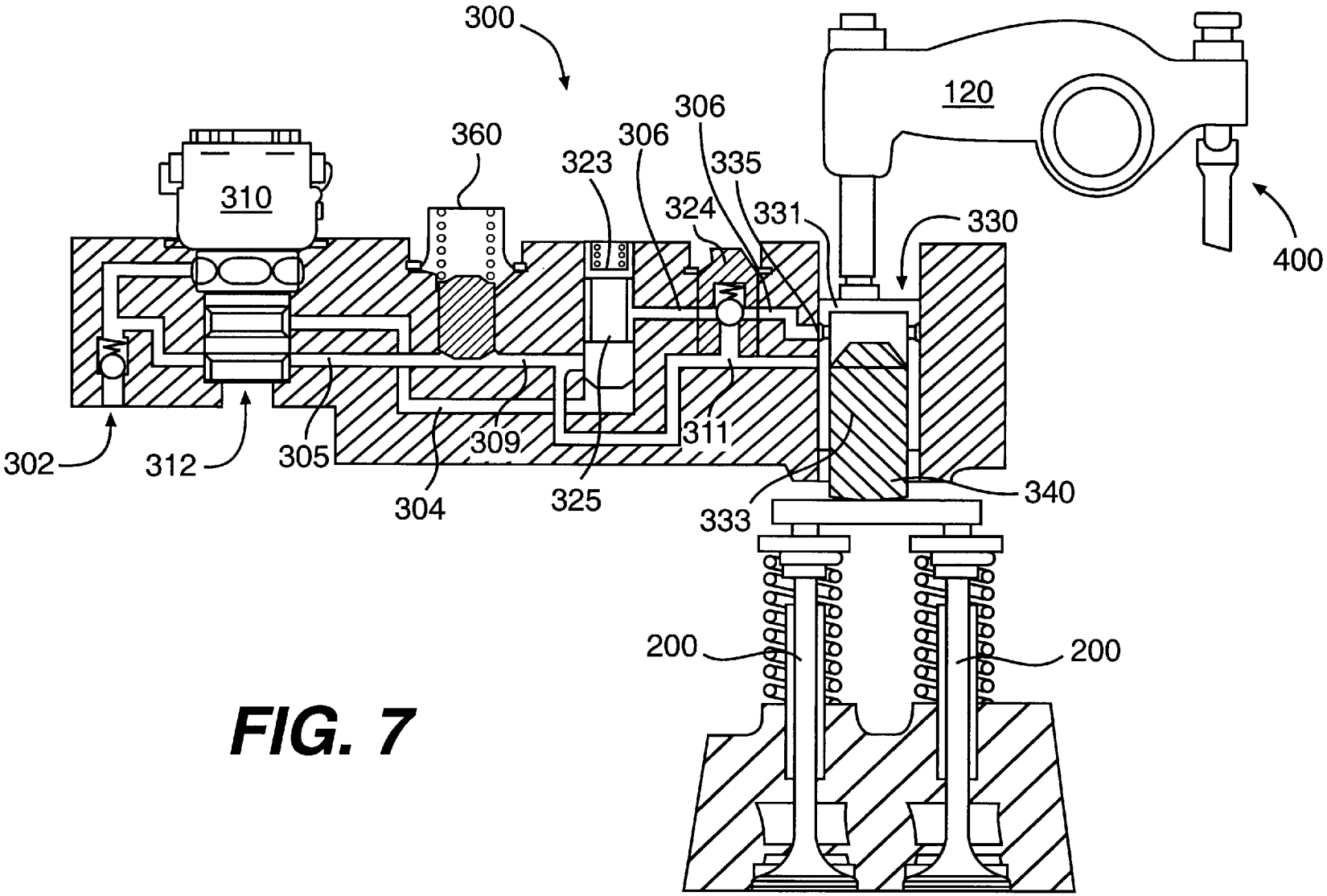
FIG. 7 is a cross-sectional view in elevation of an embodiment of the invention utilizing a hydraulic tappet and a low pressure, normally closed, on/off solenoid valve.

With reference to FIG. 7, in which like elements are referred to with like reference numerals, the hydraulic linkage 300 may be turned on for braking by energizing the normally closed solenoid valve 310. Upon opening, the solenoid valve 310 may permit low pressure oil to enter passage 304. The low pressure oil is provided from a sump (not shown) by a low pressure pump (not shown) through a check valve 302. Low pressure oil is also provided directly to passages 309 and 311 without passing through the soleniod valve. From passages 309 and 311 the oil may pass through a check valve 324. The shuttle valve 323 connects passages 305 and 306 when the solenoid is off and in a down position (positive power). The shuttle valve 323 blocks the flow of oil to the accumulator 360 from a tappet 333 when it is in the "up" position.

During braking, oil may fill the high pressure circuit and the interior chamber 331 of the tappet 333 through the check valve 324. As the rocker 120 pushes on the tappet 333, oil pressure seals the check valve 324 and the engine valves 200 are opened according to FIGS. 4 or 5. At a pre-set stroke, the tappet oil port 335 reaches the spill passages 309 and 311 and the trapped oil is drained to the accumulator 360. The tappet 333 then goes solid and further valve lift follows the standard cam profile. This truncation of motion prevents over stroking of the valve 200 and valve-to-piston contact at the next TDC. Also, normal exhaust-intake valve lift overlap is maintained. The tappet 333 is refilled for the next cycle with the oil that is stored in the accumulator 360, along with any make-up oil from passages 309 and 311.

For positive power operation, the solenoid 310 prevents oil from entering the high pressure circuit through the high pressure check valve 324. The oil passage 304 to the shuttle valve 323 is drained through the solenoid exhaust port 312 and the spool valve 323 moves to the off position. Any remaining tappet oil is directed to the accumulator 360 via the spool passage 325. The braking motion on the cam is lost as the tappet 333 collapses. Normal exhaust valve motion ensues as the oil passes to the accumulator 360 and back, and through the shuttle valve 323, at the top of each stroke. This also provides a hydraulic cushion as the tappet assembly goes solid.

Figure 8:
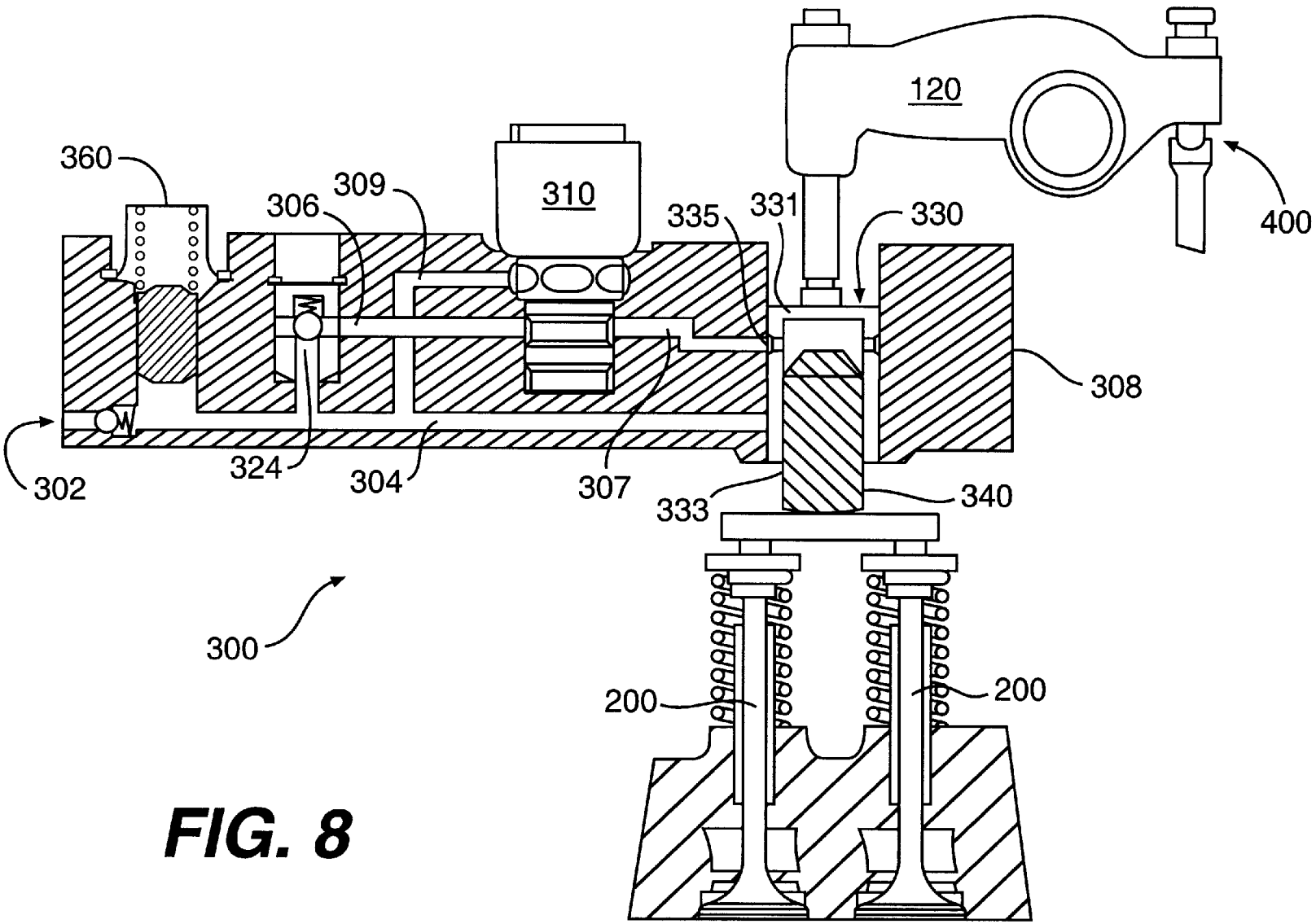
FIG. 8 is a cross-sectional view in elevation of an embodiment of the invention utilizing a hydraulic tappet and a high pressure, normally open, on/off solenoid valve.

With reference to FIG. 8, in which like elements are referred to with like reference numerals, the hydraulic linkage 300 may be turned on for braking by energizing the normally open solenoid valve 310. Once the solenoid valve 310 is closed, it isolates the oil in the high pressure circuit in the housing 308. Low pressure oil is provided from a sump (not shown) by a low pressure pump (not shown) through a check valve 302 and into a passage 304. From the passage 304 the oil may pass through a check valve 324 and into a passage 306. The low pressure oil may flow through passage 306 past the closed solenoid valve 310 and into a passage 307. From passage 307 the low pressure oil may be provided into the interior chamber 331 of a tappet 333 formed from the combination of a master piston 330 and a slave piston 340.

As the valve train element 120 displaces the tappet 333 downward, the oil in the interior chamber becomes pressurized and is forced back through passage 306 against check valve 324. Because check valve 324 is a one way valve, the oil is trapped in the interior chamber 331 until the access port 335 in the tappet 333 is displaced sufficiently downward to communicate with the passage 304. Upon communication between the access port 335 and the passage 304, the oil in the interior chamber 331 may flow rapidly, under the force of the valve springs 200, into the passage and may displace an accumulator 360 which communicates with the passage 304. As the interior chamber 331 is drained of oil, the tappet 333 may collapse and go solid, thereby limiting the downward motion which is transferred from the valve train element 120 to the valves 200. The system may be designed that some additional downward displacement of the valves 200 occurs after the tappet 333 goes solid. The system may thus be designed to provide the valve lift related to the standard cam profile (e.g. exhaust events) with a solid tappet 333 and to provide compression release and exhaust gas recirculation events with a tappet 333 containing oil in its interior chamber 331.

After the valve train element 120 reaches its maximum downward displacement, the tappet may resume its upper position. At its upper position, the access port 335 in the tappet 333 may again communicate with the passage 307 and the tappet may refill with low pressure oil for the next cycle of valve actuation.

With continued reference to FIG. 8, during positive power operation of the engine (non-braking mode), the solenoid valve 310 may be maintained in an open position. When in an open position, oil may flow freely through passage 309, through the open solenoid valve 310 and through passage 307. As the valve train element 120 displaces the tappet 333 downward, the oil in the interior chamber becomes pressurized and is forced back through passage 307, through the open solenoid valve 310, through passage 309 and against the accumulator 360. Since there is no check valve to stop the flow of oil out of the interior chamber 331, the tappet 333 collapses until the accumulator 360 goes solid or until the tappet goes solid. After the accumulator 360 or the tappet 333 go solid, any further downward movement of the valve train element 120 may be transferred to the valves 200. In this manner the extension of the tappet required for braking may be limited and the valve train motion relating to engine braking events truncated.

Hydraulic fill and spill during repeated collapsing of the tappet 333 during positive power may also benefit the overall operation of the system by providing a lubricating cycle for the tappet 333. As the oil is squeezed out of the tappet with each actuation of the valves 200 the interior walls of the master piston 330 are lubricated for the reception of the slave piston 340. In one embodiment of the invention, the accumulator 360 may be provided with a small bleed passage (not shown) for slowly bleeding the oil out of the housing during operation of the system. This slow bleeding of the oil results in circulation of the oil which is in the system, thereby allowing fresh cool oil to be introduced to the system at a constant rate. An additional benefit of using a collapsing tappet is that the interior oil creates a hydraulic cushion during tappet collapse which results in quiet operation.

Figure 9:
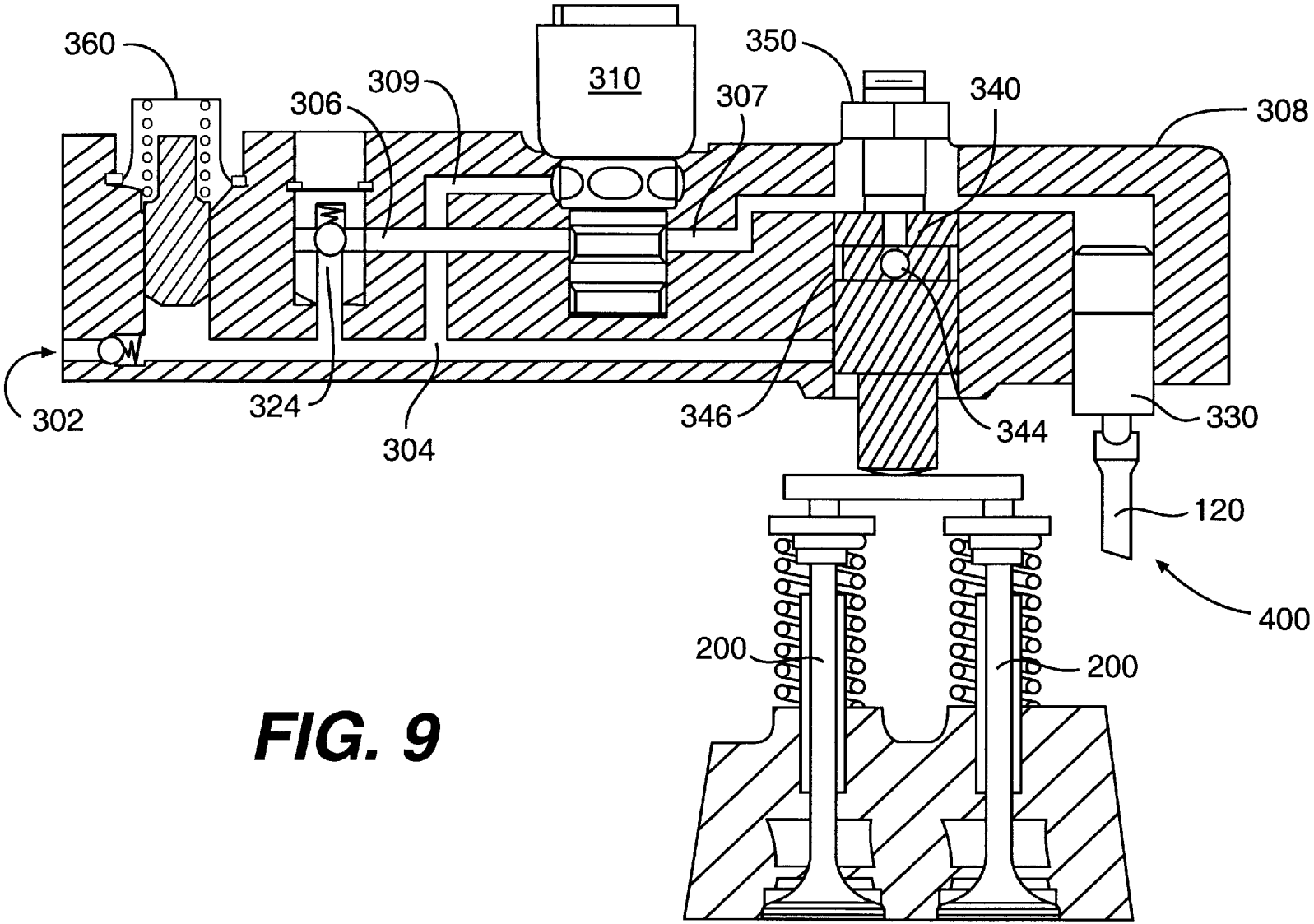
FIG. 9 is a cross-sectional view in elevation of an embodiment of the invention utilizing a master-slave piston circuit and a high pressure, normally open, on/off solenoid valve.

An alternative embodiment of the invention is shown in FIG. 9. With respect to FIG. 9, in which like elements are referred to with like reference numerals, the hydraulic linkage 300 may be turned on for braking by closing the normally open solenoid valve 310. Once the solenoid valve 310 is closed, it permits oil to be provided to the high pressure circuit in the housing 308. Low pressure oil is provided from a sump (not shown) by a low pressure pump (not shown) through a check valve 302 and into a passage 304. From the passage 304 the oil may pass through a check valve 324 and into a passage 306. The low pressure oil may flow through passage 306 past the closed solenoid valve 310 and into a passage 307. From passage 307 the low pressure oil may be provided into the circuit connecting a slave piston 340 with a master piston 330.

As the valve train element 120 displaces the master piston 330 upward, the oil in the circuit connecting the master and slave pistons becomes pressurized and is forced back through passages 307 and 309 against check valve 324. Because check valve 324 is a one way valve, the oil is trapped in the high pressure circuit and the slave piston 340 is displaced downwards as the master piston is displaced upwards. The slave piston 340 may continue downwards, thereby opening valves 200, until an annular groove 346 in the slave piston communicates with the passage 304. When the annular groove 346 communicates with the passage 304, oil in the high pressure circuit may flow rapidly through the passage 344 in the slave piston under the force of the valve springs and into the passage 304. In one embodiment of the invention, oil may not flow through the passage 344 until the passage is opened by a reset or clip valve 350. The oil may pass through passage 304 and may displace an accumulator 360 which communicates with the passage 304. As the high pressure circuit is drained of oil, the downward motion of the slave piston 340 may stop. Thereafter, the back pressure from the valves 200 may cause the slave piston 340 to be returned to its upper most position where it abuts against a lash adjuster, reset valve, or clip valve 350. In this manner, the relative placement of the annular groove 346 and the passage 304 may be used to limit the downward motion which is transferred from the valve train element 120 to the valves 200. When the slave piston 340 resumes its upper position, the high pressure circuit may refill with low pressure oil for the next cycle of valve actuation.

Similarly to the system shown in FIG. 8, the accumulator 360 may be designed to go solid, i.e. to accumulate a maximum amount of oil, before all of the oil is drained from the high pressure circuit. In this manner, the system 300 may be designed to provide further valve lift which follows the standard cam profile. This arrangement may simulate the valve actuation that is achieved using a tappet which goes solid or is partially collapsed when oil is drained to an accumulator.

During positive power operation of the engine (non-braking mode), the solenoid valve 310 may be maintained in an open position. When in an open position, oil may flow freely through passage 309, through the open solenoid valve 310 and through passage 307. As the valve train element 120 displaces the master piston 330 upward, the oil in the high pressure circuit becomes pressurized and is forced back through passage 307, the open solenoid valve 310, passage 309 and against the accumulator 360. Since there is no check valve to stop the flow of oil out of the high pressure circuit, the slave piston 340 is not displaced until the accumulator 360 goes solid (if the accumulator is designed to go solid). If and when the accumulator goes solid, the discharge of oil from the high pressure circuit may cease and the additional displacement of the master piston 330 may be transferred to the slave piston 340 via the high pressure circuit. In this manner the downward displacement of the slave piston 340 resulting from movement of the valve train element 120 may be limited.

In one embodiment of the invention, the accumulator 360 may be provided with a small bleed passage (not shown) for slowly bleeding the oil out of the housing during positive power operation of the system. This slow bleeding of the oil may result in circulation of the oil which is in the system when the solenoid is in an open position, thereby allowing fresh cool oil to introduced to the system at a constant rate.

It will be apparent to those skilled in the art that variations and modifications of the present invention can be made without departing from the scope or spirit of the invention. For example, the slave pistons, master pistons, and a tappets, contemplated as being within the scope of the invention include pistons and tappets of any shape or size so long as the elements in combination provide the function of selectively discharging hydraulic fluid from a high pressure circuit or passage to a low pressure circuit or passage responsive to the displacement of one of the elements in the combination. Furthermore, it is contemplated that the scope of the invention may extend to variations on the arrangement of the system elements in the housing, as well as variations in the choice of valve train elements (cams, rocker arms, push tubes, etc.) that may be connected to the hydraulic linkage. It is further contemplated that any hydraulic fluid may be used in the system of the invention.

Thus, it is intended that the present invention cover the modifications and variations of the invention, provided they come within the scope of the appended claims and their equivalents.

We claim:

1. An engine braking system, for providing a main exhaust valve event and a compression release valve event in an internal combustion engine, comprising:

a unitary cam lobe for imparting motion for a main exhaust valve event and a compression release valve event to an engine valve;

means for mechanically transferring motion from said unitary cam lobe to the engine valve;

means for hydraulically transferring motion from said unitary cam lobe to the engine valve, said hydraulically transferring means being capable of transferring motion independently of said mechanically transferring means; and means for controlling the amount of motion transferred by said hydraulically transferring means to the engine valve such that the motion transferred by said hydraulically transferring means is less than the motion transferred by said mechanically transferring means during the main exhaust valve event.

2. The system of claim 1 wherein said means for controlling comprises a reset mechanism.

3. The system of claim 1 wherein said means for controlling comprises a clipping mechanism.

4. The system of claim 1 wherein the means for hydraulically transferring comprises a tappet having an expansible interior chamber for receiving hydraulic fluid.

5. The engine braking system of claim 4 wherein said hydraulically transferring means further comprises an accumulator in selective hydraulic communication with said tappet, said accumulator including a passage for bleeding oil out of the system during operation of the system to thereby enable the introduction of fresh cool oil.

6. The system of claim 1 wherein the means for hydraulically transferring comprises a slave piston having a passage therein for providing selective communication between a high pressure hydraulic circuit and a low pressure hydraulic fluid circuit.

7. The engine braking system of claim 6 wherein said hydraulically transferring means further comprises an accumulator in selective hydraulic communication with said slave piston, said accumulator including a passage for bleeding oil out of the system during operation of the system to thereby enable the introduction of fresh cool oil.

8. The system of claim 1 wherein said means for hydraulically transferring comprises:

a housing having working fluid passages therein;

a master piston and a slave piston each communicating with at least one common working fluid passage in said housing;

means for charging low pressure passages in the system with a working fluid;

means for charging high pressure passages in the system with working fluid from the low pressure passages;

means for selectively discharging working fluid from the high pressure passages in the system to the low pressure passages.

9. The system of claim 8 wherein said means for selectively discharging comprises a reset mechanism.

10. The system of claim 8 wherein said means for selectively discharging comprises a clipping mechanism.

11. The system of claim 8 wherein said means for selectively discharging comprises a slave piston having working fluid passages therein which provide selective communication between said high pressure passage and said low pressure passage responsive to the displacement of said slave piston.

12. The system of claim 1 comprising a lash distance between said means for mechanically transferring motion and said engine valve such that the motion transferred by said hydraulically transferring means is greater than the motion transferred by said mechanically transferring means during the compression release valve event.

13. The system of claim 1 wherein said means for controlling further comprises a means for controlling the period of overlap between a main intake valve event and the main exhaust valve event.

14. In a method of providing a compression release valve event and a main exhaust valve event from a unitary cam lobe and in which said compression release valve event is provided by a hydraulic linkage between said valve and said cam lobe and said main exhaust event is provided by a mechanical linkage between said valve and said cam lobe, the method of limiting the stroke of the exhaust valve during the main exhaust valve event comprising the step of selectively reducing the volume of fluid in the hydraulic linkage at the conclusion of the compression release valve event and prior to the main exhaust valve event.

15. The method of claim 14 wherein said step of selectively reducing comprises the step of resetting said hydraulic linkage.

16. The method of claim 14 wherein said step of selectively reducing comprises the step of clipping said hydraulic linkage.

17. The method of claim 14 wherein said step of selectively reducing comprises the step of providing selective communication between a high pressure and a low pressure passage in said hydraulic linkage responsive to displacement of a slave piston in said hydraulic linkage.

18. An engine braking system, for providing a main exhaust valve event and a compression release valve event in an internal combustion engine, comprising:

a unitary cam lobe for imparting motion for a main exhaust valve event and a compression release valve event to an engine valve;

means for mechanically transferring motion from said unitary cam lobe to the engine valve; and means for hydraulically transferring motion from said unitary cam lobe to the engine valve, said hydraulically transferring means being capable of transferring a full range of motion to the engine valve independent of the transferring of motion by said mechanically transferring means to the engine valve.

19. The engine braking system of claim 18 wherein said means for mechanically transferring comprises a rocker arm, and said means for hydraulically transferring comprises a master piston and a slave piston.

20. The engine braking system of claim 18 wherein said means for mechanically transferring comprises a rocker arm, and said means for hydraulically transferring comprises a tappet.

21. The engine braking system of claim 18 further comprising a means for resetting said means for hydraulically transferring after a compression release valve event and before a main exhaust valve event.

22. The engine braking system of claim 18 further comprising a means for clipping the motion of said means for hydraulically transferring after a compression release valve event and before a main exhaust valve event.

23. The engine braking system of claim 19 further comprising a means for resetting said means for hydraulically transferring after a compression release valve event and before a main exhaust valve event.

24. The engine braking system of claim 19 further comprising a means for clipping the motion of said means for hydraulically transferring after a compression release valve event and before a main exhaust valve event.

25. The engine braking system of claim 20 further comprising a means for resetting said means for hydraulically tranferring after a compression release valve event and before a main exhaust valve event.

26. The engine braking sysstem of claim 20 further comprising a means for clipping the motion of said means for hydraulically transferring after a compression release valve event and before a main exhaust valve event.

* * * * *